US011104534B2

(12) United States Patent
Nishimura et al.

(10) Patent No.: US 11,104,534 B2
(45) Date of Patent: Aug. 31, 2021

(54) SHEET CONVEYER AND IMAGE FORMING APPARATUS

(71) Applicant: Brother Kogyo Kabushiki Kaisha, Nagoya (JP)

(72) Inventors: Shoichiro Nishimura, Ama-gun (JP); Hikaru Tamura, Okazaki (JP); Kazuya Kamikawa, Nagakute (JP); Yuichiro Ichinose, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 185 days.

(21) Appl. No.: 16/405,146

(22) Filed: May 7, 2019

(65) Prior Publication Data

US 2019/0344986 A1 Nov. 14, 2019

(30) Foreign Application Priority Data

May 11, 2018 (JP) ..... JP2018-091803

(51) Int. Cl.
*B65H 9/16* (2006.01)
*B65H 5/06* (2006.01)
*B65H 27/00* (2006.01)

(52) U.S. Cl.
CPC ..... *B65H 5/062* (2013.01); *B65H 27/00* (2013.01); *B65H 2404/10* (2013.01)

(58) Field of Classification Search
CPC ..... B65H 9/166; B65H 9/16; B65H 85/00; B65H 5/062; B65H 5/34; G03G 15/234; G03G 15/6567; G03G 2215/0043; G03G 2215/00438
See application file for complete search history.

(56) References Cited

U.S. PATENT DOCUMENTS

2010/0158596 A1* 6/2010 Inoue ..... B65H 5/062 399/401
2010/0327519 A1* 12/2010 Miyazawa ..... B65H 7/08 271/248
2013/0045036 A1 2/2013 Iino
2015/0117926 A1 4/2015 Iino

FOREIGN PATENT DOCUMENTS

JP 59017441 A * 1/1984 ..... B65H 9/166
JP H05-068748 A 3/1993
JP 2013-041168 A 2/2013

* cited by examiner

*Primary Examiner* — Luis A Gonzalez
(74) *Attorney, Agent, or Firm* — Banner & Witcoff, Ltd.

(57) ABSTRACT

A sheet conveyer, including a first guide with a guide surface, a second guide arranged on a side of the guide surface toward one end in a widthwise direction, a first roller arranged upstream in a conveying direction from the second guide to rotate about a first axis extending in parallel with the widthwise direction, a second roller arranged downstream in the conveying direction from the first roller to rotate about a second axis inclined with respect to the widthwise direction, and a third roller arranged downstream in the conveying direction from the second roller at a position on a side of the guide surface toward the other end in the widthwise direction outside a widthwise length of the sheet, is provided. The third roller is configured to rotate about a third axis inclined with respect to the widthwise direction.

10 Claims, 8 Drawing Sheets

SHEET CONVEYER AND IMAGE FORMING APPARATUS

CROSS REFERENCE TO RELATED APPLICATION

This application claims priority from Japanese Patent Application No. 2018-091803, filed on May 11, 2018, the entire subject matter of which is incorporated herein by reference.

BACKGROUND

Technical Field

An aspect of the present disclosure is related to a sheet conveyer and an image forming apparatus.

Related Art

An image forming apparatus with a sheet conveyer, including an inverting-conveyer unit, is known. The image forming apparatus may form an image on one side of a sheet in an image forming unit and convey the sheet by the inverting-conveyer unit to return to the image forming unit so that another image may be printed on the other side of the same sheet.

The inverting-conveyer unit may have a guide surface, and at one end in a widthwise direction, which intersects a direction to convey the sheet on the guide surface, arranged may be an oblique-conveyer roller and an edge regulating member. The oblique-conveyer roller may rotate about an axis, which inclines with respect to the widthwise direction, to apply a conveying force to the sheet being conveyed on the guide surface so that the sheet running on the guide surface may proceed downstream in the conveying direction and toward the one widthwise end of the guide surface. The edge regulating member may regulate a widthwise position of the sheet as the sheet contacts and slides on the edge regulating member. Meanwhile, a conveyer roller arranged upstream in the conveying direction from the edge regulating member may rotate about an axis extending in parallel with the widthwise direction to apply the conveying force to the sheet, which is guided on the guide surface, to move downstream in the conveying direction.

As the sheet is conveyed downstream by the conveyer roller and the oblique-conveyer roller, a trailing end of the sheet may leave the conveyer roller, and the sheet may be conveyed by the oblique-conveyer roller obliquely toward the edge regulating member. The sheet abutting the edge regulating member may align with the edge regulating member and may be guided to a predetermined position in the widthwise direction.

SUMMARY

The image forming apparatus may form images on a variety of types of sheets. When the image forming apparatus forms an image on a thicker sheet, some problems may rise. For example, a thicker sheet may weigh more and may be more rigid compared to a standard paper sheet. Therefore, a conveying resistance, which may be caused by friction between the sheet and the guide surface, to act on the sheet may tend to be greater compared to the standard paper sheet. Accordingly, an oblique conveying force produced by the oblique-conveyer roller to convey the sheet obliquely on the guide surface may be negated by the conveying resistance, and the thicker sheet may not act on the thicker sheet substantially effectively to align with the edge regulating member. As a result, the thicker sheet may be conveyed in a skewed posture with respect to the edge regulating member.

The present disclosure is advantageous in that a sheet conveyer and an image forming apparatus, which may restrain a sheet from being conveyed in a skewed posture with respect to an alignment guide, are provided.

According to an aspect of the present disclosure, a sheet conveyer, having a first guide, a second guide, a first roller, a second roller, and a third roller, is provided. The first guide includes a guide surface, which is configured to guide a sheet thereon in a conveying direction. The second guide is arranged at a position on a side of the guide surface toward one end in a widthwise direction, which is orthogonal to the conveying direction. The second guide is configured to regulate a position of the sheet in the widthwise direction by contacting the sheet being guided on the guide surface. The first roller is arranged at a position upstream in the conveying direction with respect to the second guide. The first roller is configured to rotate about a first axis extending in parallel with the widthwise direction. The first roller is configured to apply a conveying force to the sheet to be guided on the guide surface to move downstream in the conveying direction. The second roller is arranged at a position downstream in the conveying direction with respect to the first roller. The second roller is configured to rotate about a second axis inclined with respect to the widthwise direction. The second roller is configured to apply a conveying force to move the sheet being guided on the guide surface toward the one end of the guide surface in the widthwise direction. The third roller is arranged at a position downstream in the conveying direction with respect to the second roller. The third roller is arranged at a position on a side of the guide surface toward the other end in the widthwise direction outside a length of the sheet to be guided on the guide surface in the widthwise direction. The third roller is configured to rotate about a third axis inclined with respect to the widthwise direction. The third roller is configured to apply a conveying force to the sheet being guided on the guide surface to move downstream in the conveying direction and toward the one end of the guide surface in the widthwise direction.

According to an aspect of the present disclosure, an image forming apparatus having a sheet conveyer and an image forming unit is provided. The sheet conveyer includes a first guide, a second guide, a first roller, a second roller, and a third roller. The first guide includes a guide surface, which is configured to guide a sheet thereon in a conveying direction. The second guide is arranged at a position on a side of the guide surface toward one end in a widthwise direction, which is orthogonal to the conveying direction. The second guide is configured to regulate a position of the sheet in the widthwise direction by contacting the sheet being guided on the guide surface. The first roller is arranged at a position upstream in the conveying direction with respect to the second guide. The first roller is configured to rotate about a first axis extending in parallel with the widthwise direction. The first roller is configured to apply a conveying force to the sheet to be guided on the guide surface to move downstream in the conveying direction. The second roller is arranged at a position downstream in the conveying direction with respect to the first roller. The second roller is configured to rotate about a second axis inclined with respect to the widthwise direction. The second roller is configured to apply a conveying force to move the sheet being guided on the guide surface toward the one end of the guide surface in the widthwise direction. The third roller is arranged at a position downstream in the conveying direction with respect to the second roller. The third roller is arranged at a position on a side of the guide surface toward the other end in the widthwise direction outside a length of the sheet to be guided on the guide surface in the widthwise direction. The third roller is configured to rotate about a third axis inclined with respect to the widthwise direction. The third roller is configured to apply a conveying force to the sheet being guided on the guide surface to move downstream in the conveying direction and toward the one end of the guide surface in the widthwise direction. The image forming unit is configured to form an image on the sheet. The sheet conveyer is configured to convey the sheet with the image formed on one side thereof exiting the image forming unit to return to the image forming unit.

BRIEF DESCRIPTION OF THE ACCOMPANYING DRAWINGS

DETAILED DESCRIPTION

In the following paragraphs, described with reference to the accompanying drawings will be first through fourth embodiments of the present disclosure.

First Embodiment

Figure 1:
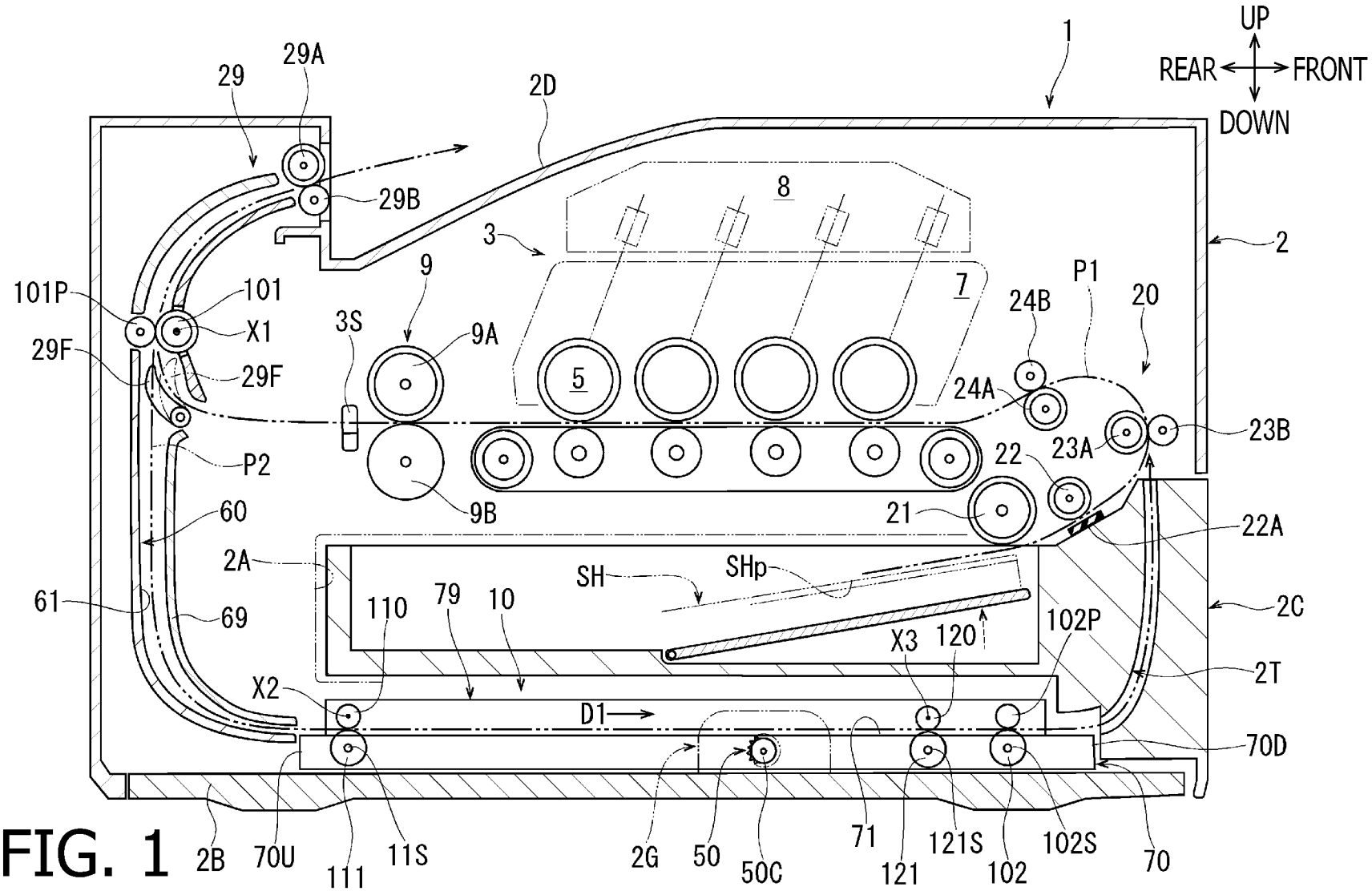
FIG. 1 is an illustrative cross-sectional view of an image forming apparatus according to a first embodiment of the present disclosure.

An image forming apparatus 1 according to the first embodiment as shown in FIG. 1 may be a color laser printer capable of conveying a sheet SH and forming a multicolored image on the sheet SH in an electro-photographic method.

In the following description, directions related the image forming apparatus 1 and each part or item included in the image forming apparatus 1 will be mentioned on basis of directions indicated by arrows in each drawing. For example, in FIG. 1, while a viewer's right-hand side is defined as a front side of the image forming apparatus 1, a user may face the front side in order to ordinarily use the image forming apparatus 1, and the user's right-hand side, which is a farther side from the viewer, and left-hand side, which is nearer side to the viewer, may be called as a rightward side and a leftward side, respectively. Moreover, a left-to-right or right-to-left direction to the user may be called as a crosswise direction. An up-to-down or down-to-up direction to the user may be called as a vertical direction. The directions shown in FIGS. 2-9 are similarly defined in the same manner and correspond to the indications by the arrows appearing in FIG. 1.

<Overall Configuration>

As shown in FIG. 1, the image forming apparatus 1 includes a body 2, a feeder unit 20, an image forming unit 3, an ejection unit 29, and an inverting-conveyer 10.

The body 2 includes a chassis and frames, which are arranged inside the chassis but not shown. Inside the body 2, arranged is a cassette compartment 2A. The cassette compartment 2A is a room, which is open frontward and recesses rearward at a lower area in the body 2.

In the cassette compartment 2A, loadable is a sheet cassette 2C having an approximate shape of a top-open box. In the sheet cassette 2C, sheets SH, on which image may be formed, may be stored in a stack. The sheets SH may include standard printing paper, OHP sheets, and thicker sheets such as cardboards. The sheet cassette 2C may be pulled frontward to be removed from the body 2.

On an upper side of the body 2, arranged is an ejection tray 2D, on which the sheets SH with images formed thereon may be placed.

The feeder unit 20, the image forming unit 3, and the ejection unit 29 are arranged inside the body 2 at upper positions with respect to the cassette compartment 2A and the sheet cassette 2C. The feeder unit 20, the image forming unit 3, and the ejection unit 29 are mounted on the frames, which are not shown. Moreover, inside the body 2, arranged are a controller and a driving source, which are not shown. The feeder unit 20, the image forming unit 3, and the ejection unit 29 are controlled by the controller and driven by a driving force transmitted from the driving source.

The inverting-conveyer 10 includes an inverting-conveyance guide 60, an inverting-conveyance guide 70, and an inverting-conveyance guide 2T.

The inverting-conveyance guide 60 extends downward from a position lower than the ejection unit 29 along a rear wall of the body 2. The inverting-conveyance guide 60 curves frontward in an area closer to a bottom 2B of the body 2 to extend to the inverting-conveyance guide 70.

The inverting-conveyance guide 70 is arranged at a lower position with respect to the cassette compartment 2A and the sheet cassette 2C inside the body 2. The inverting-conveyance guide 70 extends in the front-rear direction along the bottom 2B of the body 2.

The inverting-conveyance guide 60 and the inverting-conveyance guide 70 will be described further in detail below.

The inverting-conveyance guide 2T is formed in a frontward area with respect to the sheet cassette 2C to extend from the inverting-conveyance guide 70 to the feeder unit 20.

Inside the body 2, arranged are a conveyer path P1 and an inverting-conveyer path P2.

The conveyer path P1 is a passage extending upward from a frontward end of the sheet cassette 2C through the feeder unit 20, further extending rearward substantially horizontally through the image forming unit 3, and turning upward through the ejection unit 29 to reach the ejection tray 2D.

The inverting-conveyer path P2 is a passage extending downward from the ejection unit 29 along the inverting-conveyance guide 60, turning frontward at a lower area in the body 2, further extending frontward substantially horizontally along the inverting-conveyance guide 70, and turning to extend upward along the inverting-conveyance guide 2T to reach the feeder unit 20.

The feeder unit 20 may feed the sheets SH stored in the sheet cassette 2C one-by-one to the conveyer path P1 by a feeder roller 21, a separator roller 22, and a separator pad 22A. Moreover, the feeder unit 20 may convey the sheets SH toward the image forming unit 3 by paired conveyer rollers 23A, 23B and paired registration rollers 24A, 24B, which are arranged in an area where the conveyer path P1 turns.

The image forming unit 3 in the present embodiment is a direct tandem printer, capable of printing images in multiple colors, in a known configuration having a process cartridge 7, a scanner 8, and a fuser 9.

The process cartridge 7 is an assembly of a four (4) cartridges, which correspond to colors of black, yellow, magenta, and cyan and align in line along the horizontal part of the conveyer path P1. The process cartridge 7 includes four photosensitive drums 5, four developing rollers (not shown), four chargers (not shown), and four toner containers (not shown), each of which corresponds to one of the four colors.

The scanner 8 includes laser beam sources, polygon mirrors, fθ lenses, and reflecting mirrors, which are not shown. The scanner 8 may emit laser beams at the photosensitive drums 5 in the process cartridge 7.

The fuser 9 is arranged at a rearward position with respect to the process cartridge 7. The fuser 9 includes a heat roller 9A located at an upper position with respect to the conveyer path P1 and a pressure roller 9B to be pressed against the heat roller 9A from below across the conveyer path P1. The fuser 9 may apply heat and pressure through the heat roller 9A and the pressure roller 9B to the sheet SH passing through a position below the process cartridge 7.

At a rearward position with respect to the heat roller 9A and the pressure roller 9B, arranged across the conveyer path P1 is a sensor 3S. The sensor 3S may be, for example, in a known sensor assembly having an actuator, which may be hit by the sheet SH and swing, and an optical sensor such as a photo-interrupter, which may detect the swing motion of the actuator.

As the sensor 3S detects the sheet SH exiting the fuser 9, the event of detection is transmitted to the controller. The controller may determine progress of the image forming operation in the image forming unit 3 based on the detected event and control timings for the behaviors of the units and items described above.

The image forming unit 3 may form images on the sheets SH being conveyed in the conveyer path P1 in the following procedure. First, the chargers may charge surfaces of the photosensitive drums 5 evenly positively as the photosensitive drums 5 rotate. Next, the laser beams for the four colors emitted from the scanner 8 may scan on the surfaces of the photosensitive drums 5. The areas on the surfaces of the photosensitive drums 5 exposed to the laser beams may form electrostatic latent images corresponding to an image to be formed on the sheet SH. Next, toners in the toner containers may be supplied to the electrostatic latent images formed on the surfaces of the photosensitive drums 5. While the sheet SH is stored in the cassette 2C, the sheet SH is in a posture to have a first side SHp thereof facing downward. As the sheet SH is conveyed in the conveyer path P1 and travels through the image forming apparatus 2, the first side SHp of the sheet SH faces upward toward the photosensitive drums 5. Therefore, the toners carried on the surfaces of the photosensitive drums 5 may be transferred onto the first side SHp of the sheet SH and fused thereon by the heat and the pressure in the fuser 9. Thus, the toners may be fixed onto the sheet SH.

The ejection unit 29 includes an ejection roller 29A, an ejection pinch roller 29B, a flapper 29F, a first roller 101, and a first pinch roller 101P.

The ejection roller 29A and the ejection pinch roller 29B are located at most downstream positions along the conveyer path P1 in adjacent to the ejection tray 2D. The flapper 29F is arranged at a rearward position with respect to the fuser 9 where the conveyer path P1 starts turning upward. The first roller 101 and the first pinch roller 101P are arranged at upper positions with respect to the flapper 29F in the conveyer path P1.

The ejection roller 29A may rotate in either a normal or reverse rotating directions under the control of the controller. The ejection pinch roller 29B is arranged at a lower position with respect to the ejection roller 29A and is pressed against the ejection roller 29A. The ejection pinch roller 29B may subordinately rotate along with the normal or reverse rotation of the ejection roller 29A.

The flapper 29F is swingably supported by the frame inside the body 2 at a lower end portion thereof and may swing between a position drawn in solid lines in FIG. 1 and a position drawn in dash-and-dots lines in FIG. 1. The flapper 29F may be maintained normally at the position drawn in the dash-and-dots lines in FIG. 1 by a spring, which is not shown. The spring is arranged such that the intensity thereof is substantially small to allow the flapper 29F to swing to the position drawn in the solid lines in FIG. 1 when a leading edge of the sheet SH being conveyed in the conveyer path P1 hits the flapper 29F and allow the sheet SH to travel upward while the sheet SH is being conveyed.

The first roller 101 may rotate either in a normal or reverse rotating direction synchronously with the ejection roller 29A under the control of the controller. The first pinch roller 101P is arranged at a rearward position with respect to the first roller 101 and is pressed against the first roller 101. The first pinch roller 101P may subordinately rotate along with the normal or reverse rotation of the first roller 101.

When an image is formed solely on the first side SHp of the sheet SH, the first roller 101 and the ejection roller 29A may rotate in the normal rotating direction with the sheet SH being nipped between the first roller 101 and the first pinch roller 101P, and between the ejection roller 29A and the ejection pinch roller 29B so that the sheet SH may be ejected at the ejection tray 2D.

Meanwhile, in order to convey the sheet SH in the conveyer path P1 toward the ejection tray 2D, the flapper 29F being pushed by the sheet SH may stay at the position drawn in the solid lines in FIG. 1 without blocking the sheet SH. Rather, the flapper 29F may guide the sheet SH to the position where the sheet P may be nipped between the first roller 101 and the first pinch roller 101P.

On the other hand, when the flapper 29F is at the position drawn in the dash-and-dots lines in FIG. 1, the flapper 29F is in a posture to block the conveyer path P1 and align along the inverting-conveyer path P2. In this posture, the flapper 29F may guide the sheet SH to the inverting-conveyer path P2 so that the sheet SH may return to the image forming unit 3 without being ejected.

The ejection roller 29A, the ejection pinch roller 29B, the sensor 3S, the flapper 29F, the first roller 101, and the first pinch roller 101P described above may serve as an inverting device to invert the sheet SH with the image formed on the first side SHp thereof upside-down in the following procedure.

First, while the sheet SH is nipped between the first roller 101 and the first pinch roller 101P and between the ejection roller 29A and the ejection pinch roller 29B to be conveyed toward the ejection tray 2D, at a predetermined timing since the sensor 3S no longer detects presence of the sheet SH, the controller may switch the rotating directions of the ejection roller 29A and the first roller 101 from the normal rotating direction to the reverse rotating direction. The predetermined timing may be set to be later than a timing when a trailing edge of the sheet SH passes by the flapper 29F and the flapper 29F returns to the position drawn in the dash-and-dots lines in FIG. 1. In this arrangement, the sheet SH may be conveyed to the inverting-conveyer path P2 by the behaviors of the first roller 101, the first pinch roller 101P, the ejection roller 29A, the ejection pinch roller 29B, and the flapper 29F.

The first roller 101 and the first pinch roller 101P may serve as a part of the inverting-conveyer 10 to convey the sheet SH entering the inverting-conveyer path P2 further to an intermediate position in the inverting-conveyer path P2.

The sheet SH conveyed in the inverting-conveyer path P2 may be guided by the inverting-conveyance guide 60, by the inverting-conveyance guide 70, and thereafter by the inverting-conveyance guide 2T in the inverting-conveyer 10 to reenter the conveyer path P1. The sheet SH reentering the conveyer path P1 may be again conveyed by the paired conveyer rollers 23A, 23B and the paired registration rollers 24A, 24B in the feeder unit 20 to return to the image forming unit 3 with a second side opposite to the first side SHp facing upward. Thus, the image may be formed on the second side of the sheet SH in the same manner as the first side SHp. The sheet SH with the images formed on both sides thereof may be ejected by the ejection roller 29A and the ejection pinch roller 29B at the ejection tray 2D.

According to the present embodiment, the inverting-conveyer 10 including the inverting-conveyance guide 60, the inverting-conveyance guide 70, the first roller 101, the first pinch roller 101P, an alignment guide 30, a side chute 40, a pin 49, a first driving roller 111, a second roller 110, a second driving roller 121, a third roller 120, a fourth roller 102, and a second pinch roller 102P, which are in an arrangement as described below, and as shown in FIGS. 2-6, may regulate a posture of the sheet SH so that the sheet SH to be inverted may be placed at a predetermined position in a widthwise direction W1.

<Configuration of the Inverting-Conveyance Guide 60>

The inverting-conveyance guide 60 includes a guide surface 61. An upper edge of the guide surface 61 is located at a lower position with respect to the first pinch roller 101P. The guide surface 61 extends downward from the upper edge along the rear wall of the body 2 and curves to orient frontward in the area adjacent to the bottom 2B of the body 2. The guide surface 61 may guide the sheet SH, which is conveyed by the first roller 101 and the first pinch roller 101P, to the inverting-conveyer path P2.

In the body 2, arranged to oppose the guide surface 61 of the inverting-conveyance guide 60 is an opposing guide plate 69. An upper edge of the opposing guide plate 69 is located at a lower position with respect to the flapper 29E The opposing guide plate 69 extends downward from the upper edge and curves to orient frontward along the guide surface 61.

A course to convey the sheet SH along the inverting-conveyer path P2 changes directions thereof from downward to frontward as the sheet SH is guided by the first inverting-conveyance guide 60. Further, the direction of the course to guide the sheet SH by the inverting-conveyance guide 70 is a frontward and horizontal direction. In the following paragraphs, positions of each item or member in the image forming apparatus 1 will be described on basis of a conveying direction D1 being the frontward direction, in which the sheet SH to be inverted is guided by the inverting-conveyance guide 70.

<Configuration of the Inverting-Conveyance Guide 70>

Figure 2:
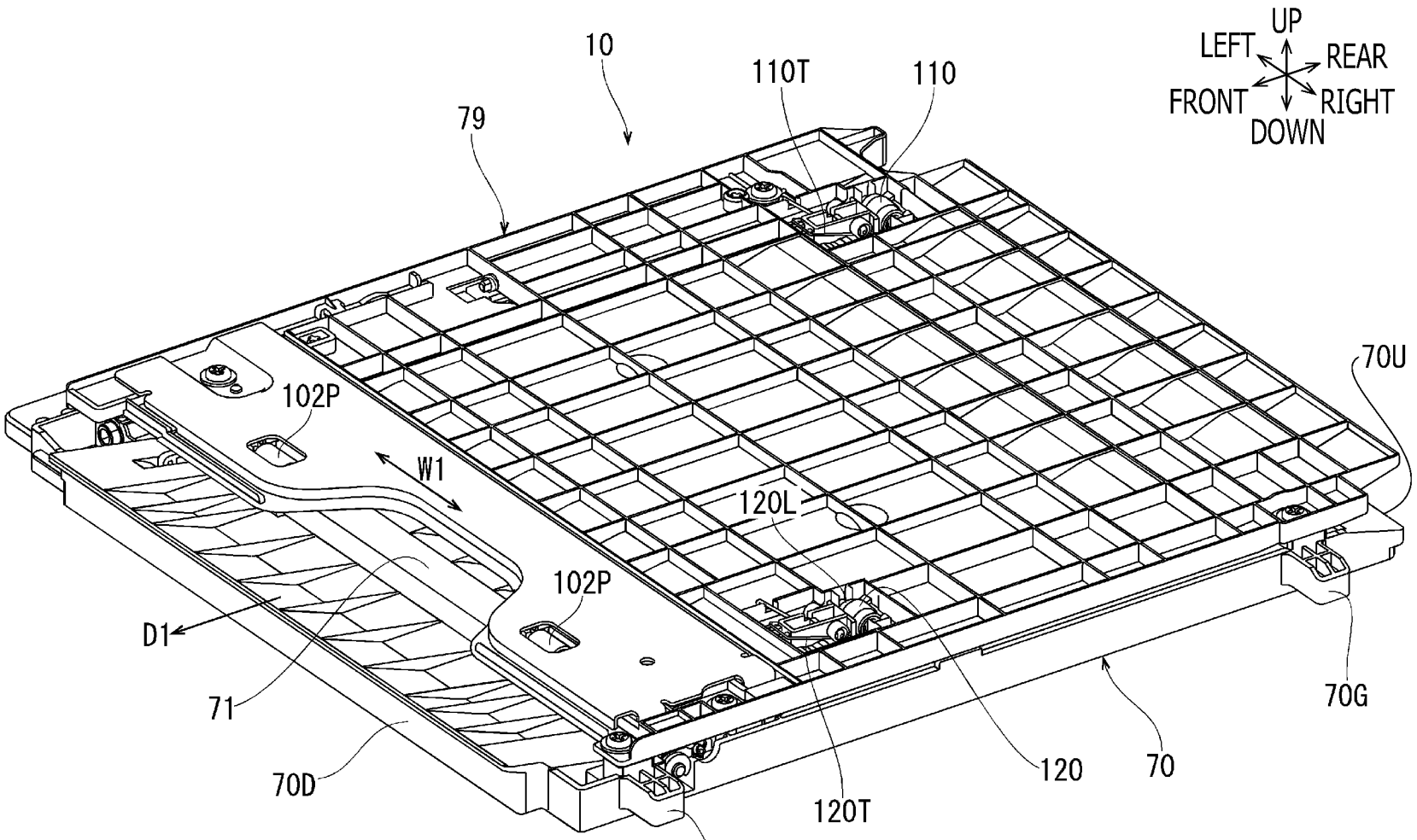
FIG. 2 is a perspective view of an inverting-conveyance guide with an upper guide plate attached thereto, a second roller, and a third roller for the image forming apparatus according to the first embodiment of the present disclosure.

The inverting-conveyance guide 70 is arranged at a downstream position in the conveying direction D1 with respect to the inverting-conveyance guide 60. The inverting-conveyance guide 70 may be, for example, a piece of an approximately rectangular-shaped thermoplastic resin plate formed in injection molding. As shown in FIGS. 1 and 2, the inverting-conveyance guide 70 is attached to the body 2 in an arrangement such that an upper guide plate 79 faces the inverting-conveyance guide 70 from above.

Figure 3:
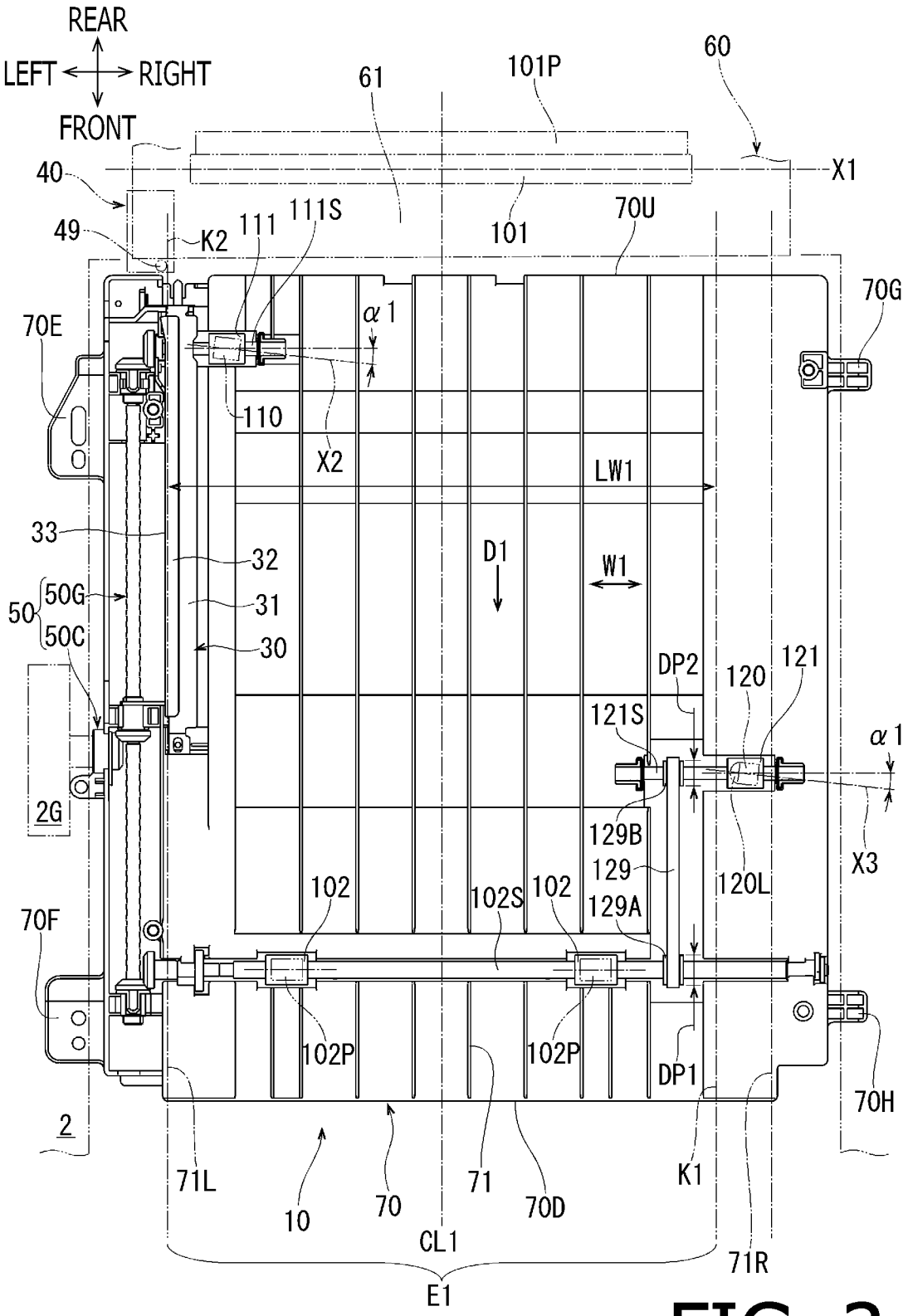
FIG. 3 is a plan view of inverting-conveyance guides, a first roller, the second roller, the third roller, a first driving roller, a second driving roller, and a fourth roller for the image forming apparatus according to the first embodiment of the present disclosure.
Figure 4:
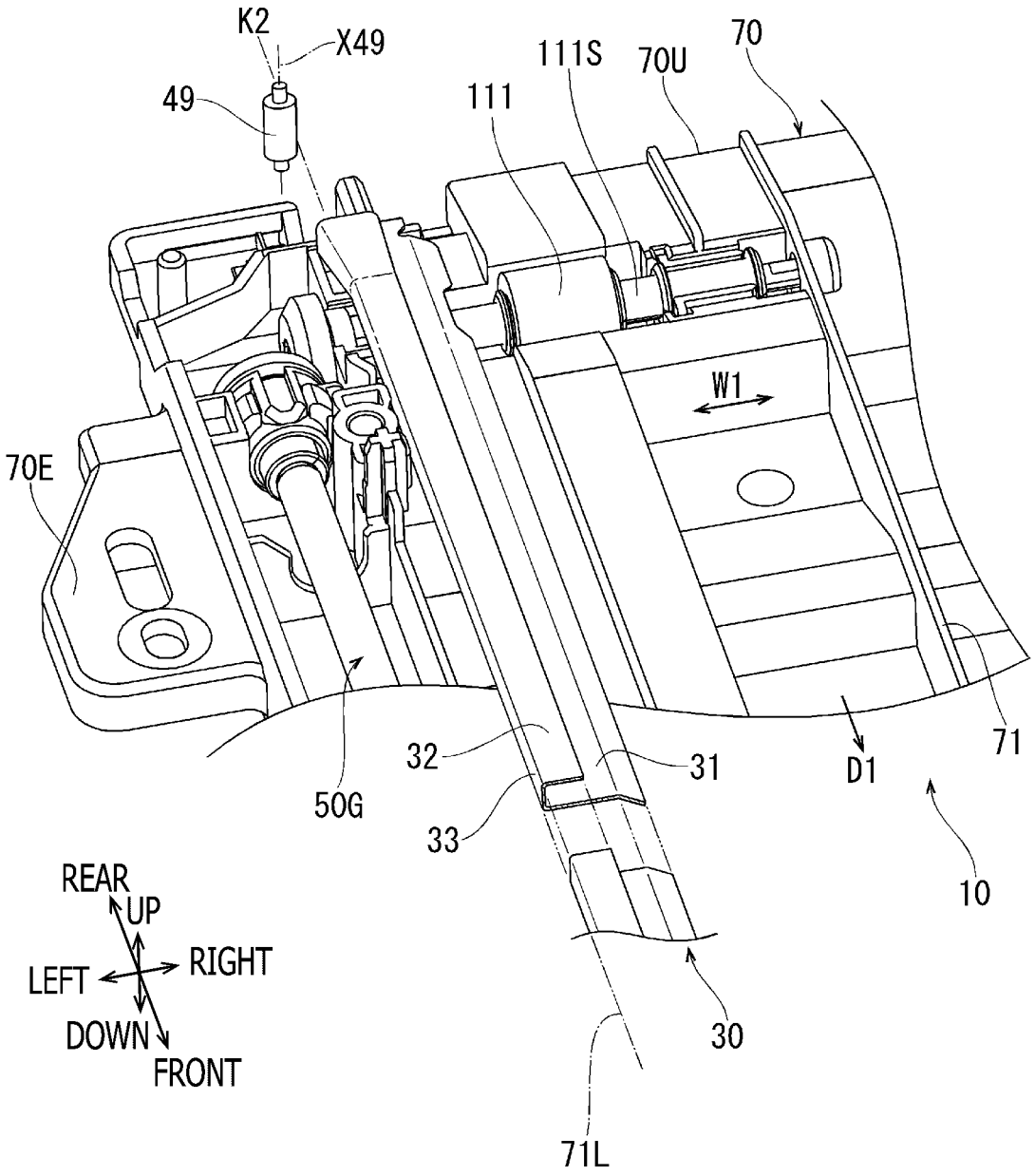
FIG. 4 is a perspective view of the inverting-conveyance guide, an alignment guide, a pin, and the first driving roller for the image forming apparatus according to the first embodiment of the present disclosure.

As shown in FIGS. 3-4, the inverting-conveyance guide 70 includes a guide surface 71. The guide surface 71 is formed on a plane, where upper edges of ribs and protrusions formed in the inverting-conveyance guide 70 align. In other words, the guide surface 71 forms a part of an upper surface of the inverting-conveyance guide 70. As shown in FIG. 3, the guide surface 71 extends from an upstream end 70U to a downstream end 70D of the inverting-conveyance guide 70 along the conveying direction D1. The guide surface 71 may guide the sheet SH thereon to be conveyed in the conveying direction D1 along the horizontal part of the inverting-conveyer path P2.

A width of the guide surface 61 of the inverting-conveyance guide 60 and a width of the guide surface 71 of the inverting-conveyance guide 70 align with a widthwise direction W1. The widthwise direction W1 coincides with the crosswise direction and is orthogonal to the conveying direction D1. One end of the guide surface 61 in the widthwise direction W1 may be a leftward end, and the other end of the guide surface 61 in the widthwise direction W1 may be a rightward end. A first widthwise end 71L being one end of the guide surface 71 in the widthwise direction W1 may be a leftward end, and a second widthwise end 71R being the other end of the guide surface 71 in the widthwise direction W1 may be a rightward end.

As shown in FIG. 2, the upper guide plate 79 is fastened to the ends of the inverting-conveyance guide 70 in the widthwise direction W1 through, for example, screws at the ends thereof in the widthwise direction W1 at a position spaced apart upward from the guide surface 71. Thereby, as shown in FIG. 1, a clearance to allow the sheet SH to be conveyed there-through is maintained between the guide surface 71 and the upper guide plate 79.

As shown in FIG. 3, the first widthwise end 71L of the guide surface 71 extends in the front-rear direction, which is the conveying direction D1, at a rightward position with respect to a leftward end of the inverting-conveyance guide 70. The second widthwise end 71R of the guide surface 71 extends in parallel with the first widthwise end 71L at a leftward position with respect to a rightward end of the inverting-conveyance guide 70. In other words, the guide surface 71 is narrower in the widthwise direction W1 than a width of the inverting-conveyance guide 70.

The inverting-conveyance guide 70 is attached to the body 2 by engagement between engaging portions 70E, 70F, 70G, 70H (see FIG. 3) and the frame in the body 2. Meanwhile, although not shown in the accompanying drawings, the inverting-conveyance guide 70 is removable from the body 2 by disengaging the engaging portions 70E, 70F, 70G, 70H from the frame. Moreover, the removed inverting-conveyance guide 70 is attachable back to the body 2 by placing the engaging portions 70E, 70F, 70G, 70H engaged with the frame.

<Configuration of the Alignment Guide>

The alignment guide 30 may be a metal plate bent partly in an approximate shape of C in a cross-sectional view and is elongated in the conveying direction D1, as shown in FIGS. 3 and 4. The alignment guide 30 includes a first guide wall 31, a second guide wall 32, and a third guide wall 33.

The first guide wall 31 is arranged on a side of the guide surface 71 toward the first widthwise end 71L and extends on a plane spreading substantially in parallel with the guide surface 71. The third guide wall 33 extends upward from a leftward edge of the first guide wall 31 on a plane spreading along the conveying direction D1. The second guide wall 32 extends rightward from an upper edge of the third guide wall 33 to face the first guide wall 31 on a plane spreading along the conveying direction D1.

As shown in FIG. 3, the third guide wall 33 is arranged on the first widthwise end 71L of the guide surface 71 and extends longitudinally in the conveying direction D1.

The first guide wall 31 in the alignment guide 30 may guide the sheet SH conveyed on the guide surface 71 from below. The second guide wall 32 may guide the sheet SH being conveyed on the guide surface 71 from above. The third guide wall 33 may contact a leftward edge of the sheet SH being conveyed on the guide surface 71 to guide the leftward edge of the sheet SH align with the first widthwise end 71L of the guide surface 71 and regulate the widthwise position of the sheet SH.

<Configuration of Regulative Area in the Guide Surface 71>

On the guide surface 71, defined is an regulative area E1, in which the sheet SH may be conveyed in a regulated posture at a predetermined position on the guide surface 71 in the widthwise direction W1. In the present embodiment, a size of the sheet SH to be conveyed to return to the image forming unit 3 is limited to a specific size. For example, the specific size may be A4 size. Meanwhile, the specific size may not necessarily be limited to A4 size but may be another size (e.g., legal). The sheet SH in the specific size may include thinner paper, standard paper with a regular thickness, and thicker paper such as a cardboard.

The regulative area E1 is located at a position, in which a leftward edge thereof coincides with the first widthwise end 71L of the guide surface 71, and in which a rightward end thereof coincides with a boundary line K1. The boundary line K1 is a position on a side of the guide surface 71 toward the second widthwise end 71R in the widthwise direction W1 and extends in the conveying direction D1 at a position spaced apart from the third guide wall 33 of the alignment guide 30 for a length LW1 in the widthwise direction W1. The length LW1 is a width of the sheet SH to be guided on the guide surface 71 in the widthwise direction W1. In other words, a length of the regulative area E1 in the widthwise direction W1 is the length LW1 of the sheet SH in the widthwise direction W1. In the present embodiment, the length LW1 is a length the shorter side of the A4 size being the specific size. A center line CL1 at the center of the regulative area E1 in the widthwise direction W1 coincides with a widthwise center of the image forming unit 3. The length LW1 of the regulative area E1 in the widthwise direction W1 is a maximum allowable width for the sheet SH that may be conveyed in the image forming apparatus 1.

<Configurations of First Roller and First Pinch Roller>

As shown in FIG. 3, the first roller 101 and the first pinch roller 101P are arranged at upstream positions in the conveying direction D1 with respect to the alignment guide 30. The first roller 101 is rotatably supported about a first axis X1, which extends in parallel with the widthwise direction W1. A length of the first roller 101 and the first pinch roller 101P in the widthwise direction W1 may be slightly smaller than the length LW1 of the regulative area E1 in the widthwise direction W1.

The first roller 101 in conjunction with the first pinch roller 101P nips the sheet SH being guided along the guide surfaces 61, 71 and applies a conveying force to the sheet SH being guided to the guide surface 71 to move downstream in the conveying direction D1. Meanwhile, a posture of the sheet SH may be regulated correctly so that a portion of the sheet SH pinched between the first roller 101 and the first pinch roller 101P elongated in the widthwise direction W1 may not skew with respect to the conveying direction D1.

<Configurations of Side Chute and Pin>

As shown in a simplified form in FIG. 3, the side chute 40 is arranged at a leftward end portion of the inverting-conveyance guide 60 that faces an upstream end portion 70U of the inverting-conveyance guide 70. In other words, the side chute 40 is arranged at a position downstream with respect to the first roller 101 and upstream with respect to the alignment guide 30 in the conveying direction D1. The side chute 40 has guiding surfaces, which are in an approximate shape of C in a cross-sectional view, to guide the leftward edge of the sheet SH to the guide surface 61. A metal-made pin 49 is supported by a downstream end portion of the side chute 40 in the conveying direction D1.

As shown in FIG. 4, the pin 49 has a cylindrical shape centered at an axis X49, which extends orthogonally to the guide surface 71, i.e., in the vertical direction.

As shown in FIG. 3, a rightward end of an outer circumferential surface of the pin 49 adjoins an extended line K2, which is extended upstream in the conveying direction D1 from the first widthwise end 71L of the guide surface 71. The rightward end of the outer circumferential surface of the pin 49 may restrict the position of the sheet SH in the widthwise direction W1 by contacting the leftward edge of the sheet SH being guided along the guide surfaces 61, 71. Thus, the side chute 40 may guide the sheet SH so that the leftward edge of the sheet SH may slide on the outer circumferential surface of the pin 49 without colliding the pin 49 and slide on the third guide wall 33 of the guide 30.

<Configurations of First Driving Roller, Second Roller, Second Driving Roller, Third Roller, Fourth Roller, and Second Pinch Roller>

As shown in FIG. 3, the first driving roller 111 is arranged at a position on a side of the inverting-conveyance guide 70 toward the upstream end 70U in the conveying direction D1 and closer to the first widthwise end 71L of the guide surface 71 in the widthwise direction W1. The first driving roller 111 is fixed to a rotation shaft 111S, which extends in parallel with the widthwise direction W1, to rotate integrally with the rotation shaft 111S.

The second roller 110 is arranged at a position to face the first driving roller 111 from above. As shown in FIG. 2, the second roller 110 is supported by the upper guide plate 79.

The second roller 110 is urged against the first driving roller 111 by an urging spring 110T. In other words, the first driving roller 111 is arranged on a same side of the inverting-conveyance guide 70 as the guide surface 71 rather than a side of the upper guide plate 79 and faces the second roller 110, which is on the opposite side of the inverting-conveyance guide 70 across the inverting-conveyer path P2.

As shown in FIG. 3, the first driving roller 111 and the second roller 110 are arranged downstream in the conveying direction D1 with respect to the first roller 101 and the first pinch roller 101P within the regulative area E1 in the guide surface 71.

A second axis X2 being a rotation axis of the second roller 110 inclines with respect to the widthwise direction W1 with a rightward end thereof being closer toward downstream in the conveying direction D1 than a leftward end thereof. The second axis X2 inclines with respect to the widthwise direction W1 at an angle α1.

The second driving roller 121 is arranged at a position in the conveying direction D1 between the upstream end 70U and a downstream end 70D of the inverting-conveyance guide 70. Moreover, the second driving roller 121 is arranged at a position in the widthwise direction W1 between the boundary line K1 and the second widthwise end 71R of the guide surface 71. The second driving roller 121 is fixed to a rotation shaft 121S, which extends in parallel with the widthwise direction W1, to rotate integrally with the rotation shaft 121S.

The third roller 120 is arranged at a position to face the second driving roller 121 from above. The third roller 120 is arranged on a side of the guide surface 71 toward the second widthwise end 71R in the widthwise direction W1 and outside the length LW1 of the sheet SH to be guided along the third guide wall 33 of the alignment guide 30 and the guide surface 71. In the present embodiment, the third roller 120 is arranged at a position in the widthwise direction W1 rightward from the length LW1 of the sheet SH and leftward from the second widthwise end 71R of the guide surface 71.

A leftward end 120L of the third roller 120 is spaced apart from a rightward end of the regulative area E1, in other words, from the boundary line K, for a distance approximately between 1.00 and a few millimeters. For example, the leftward end 120L of the third roller 120 may be apart from the boundary line K1 for 2.5 mm. The position of the leftward end 120L of the third roller 120 may be determined in consideration of the position of the third guide wall 33 of the alignment guide 30 so that the third roller 120 may not affect the course of the sheet SH that travels correctly in the regulative area E1. Meanwhile, the leftward end 120L of the third roller 120 is in a round form, or a hemispherical form bulging leftward.

As shown in FIG. 2, the third roller 120 is supported by the upper guide plate 79. The third roller 120 is urged against the second driving roller 121 by an urging spring 120T. In other words, the second driving roller 121 is arranged on a same side of the inverting-conveyance guide 70 as the guide surface 71 rather than the side of the upper guide plate 79 and faces the third roller 120, which is on the opposite side of the inverting-conveyance guide 70 across the inverting-conveyer path P2. In the present embodiment, a spring load by the urging spring 110T and a spring load by the urging spring 120T are equal. In other words, an intensity of the force to urge the sheet SH being guided to the guide surface 71 against the second roller 110 and an intensity of the force to urge the sheet SH being guided to the guide surface 71 against the third roller 120 are equal.

As shown in FIG. 3, the second driving roller 121 and the third roller 120 are arranged downstream in the conveying direction D1 with respect to the first driving roller 111 and the second roller 110 at a position displaced rightward in the widthwise direction W1 from the regulative area E1 in the guide surface 71.

A third axis X3 being a rotation axis of the third roller 120 inclines with respect to the widthwise direction W1 with a rightward end thereof being closer toward downstream in the conveying direction D1 than a leftward end thereof. The third axis X3 inclines with respect to the widthwise direction W1 at the angle α1, which is equal to the inclination angle of the second axis X2 with respect to the widthwise direction W1.

Figure 5:
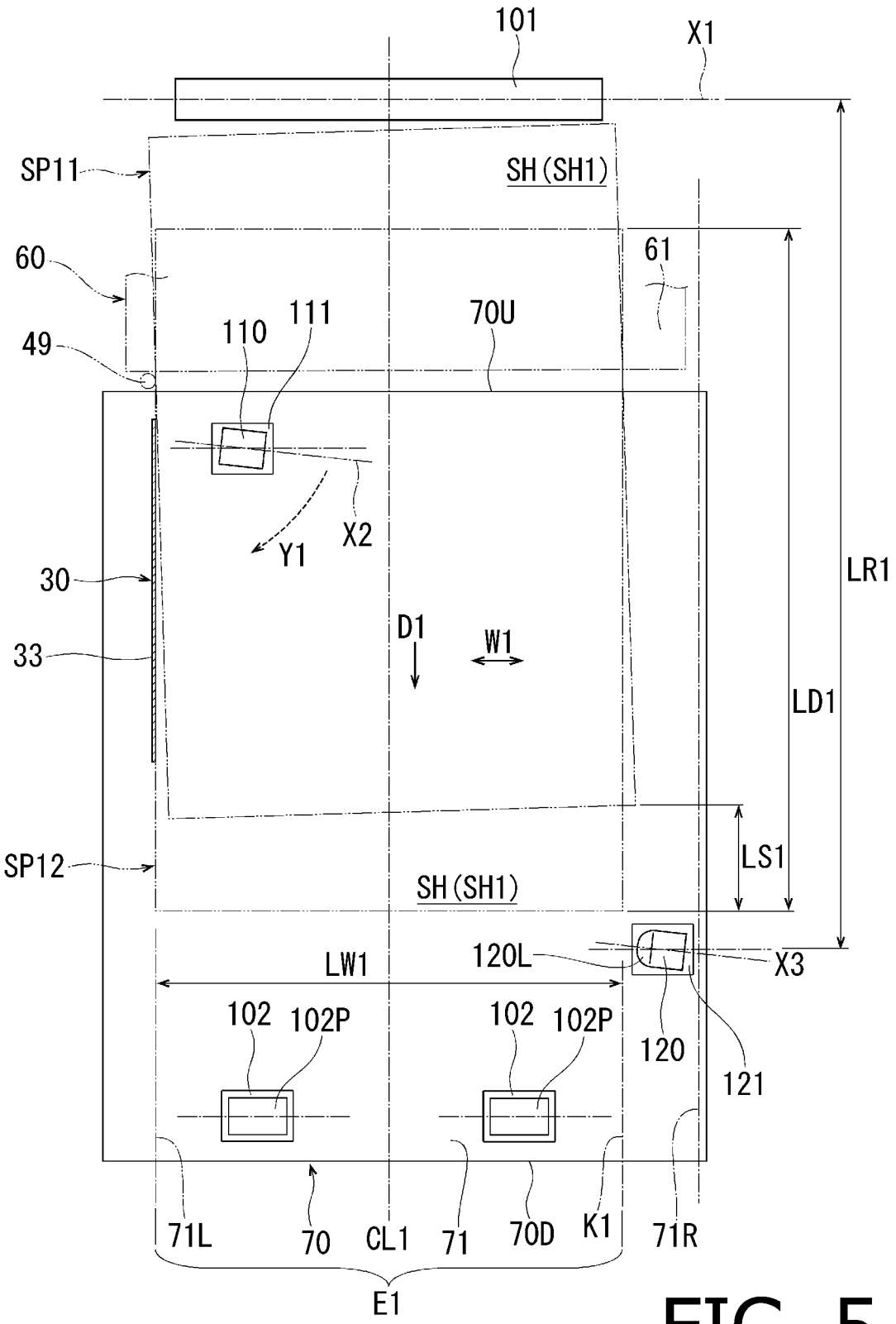
FIG. 5 is a plan view to illustrate an arrangement of the alignment guide, the pin, the first roller, the second roller, and the third roller for the image forming apparatus according to the first embodiment of the present disclosure.

As shown in FIG. 5, a distance LR1 in the conveying direction D1 between the first roller 101 and the third roller 120 is greater than a length LD1 of the sheet SH in the conveying direction D1. In the present embodiment, the length LD1 is a length of the longer side of the sheet SH in the A4 size being the specific size. In FIG. 5, the first roller 101 and the third roller 120 (see also FIG. 1) are drawn on a same plane for an illustrative purpose; in this regard, the first roller 101 is drawn to be farther rearward from the position of the first roller 101 than in an actual scale.

As shown in FIG. 3, the fourth roller 102 includes two (2) pieces of fourth rollers 102 arranged on a side of the inverting-conveyance guide 70 toward the downstream end 70D in the conveying direction D1. The fourth rollers 102 are fixed to a rotation shaft 102S, which extends in parallel with the widthwise direction W1, to rotate integrally with the rotation shaft 102S. A leftward one of the fourth roller 102 is arranged leftward with respect to the center line CL1 in the regulative area E1. A rightward one of the fourth roller 102 is arranged rightward with respect to the center line CL1 in the regulative area E1.

The second pinch roller 102P includes two (2) pieces of second pinch rollers 102P, which correspond to the two pieces of fourth rollers 102, respectively. A leftward one of the second pinch rollers 102P is arranged to face the leftward one of the fourth rollers 102 from above. A rightward one of the second pinch rollers 102P is arranged to face the rightward one of the fourth rollers 102 from above. As shown in FIG. 2, the second pinch rollers 102P are supported by the upper guide plate 79. The leftward one of the second pinch rollers 102P is urged against the leftward one of the fourth rollers 102 by an urging spring, which is not shown. The rightward one of the second pinch rollers 102P is urged against the rightward one of the fourth rollers 102 by an urging spring, which is not shown.

The fourth rollers 102 and the second pinch rollers 102P are arranged downstream in the conveying direction D1 with respect to the second driving roller 121 and the third roller 120 within the regulative area E1 in the guide surface 71.

As shown in FIGS. 1 and 3, in the body 2, arranged is an in-body transmission 2G The in-body transmission 2G is attached to the frame of the body 2 at a leftward position with respect to a leftward face of the inverting-conveyance guide 70.

As shown in FIG. 3, between the leftward face of the inverting-conveyance guide 70 and the first widthwise end 71L of the guide surface 71, arranged is a transmission 50, which includes a coupler 50C and a transmission gear assembly 50G.

The coupler 50C is coupled with the in-body transmission 2G through a removable coupling (not shown). In other words, the in-body transmission 2G and the coupler 50C on the inverting-conveyance guide 70 are coupled with each other through the removable coupling. In order to remove the inverting-conveyance guide 70 from the body 2, the coupler 50C may be decoupled from the in-body transmission 2G.

The transmission gear assembly 50G includes a plurality of bevel gears and transmission shafts. The transmission gear assembly 50G couples the coupler 50C with the rotation shaft 111S of the first driving roller 111 and with the rotation shaft 102S of the fourth roller 102.

To the rotation shaft 102S of the fourth roller 102, fixed is a pulley 129A. To the rotation shaft 121S of the second driving roller 121, fixed is a pulley 129B. A timing belt 129 is wound around the pulley 129A and the pulley 129B.

As the feeder unit 20, the image forming unit 30, and the ejection unit 29 are driven under the control of the controller, the driving force from the driving source may be transmitted through the in-body transmission 2G and the coupler 50C to the transmission 50. The transmission 50 may transmit the driving force through the transmission gear assembly 50G to the rotation shafts 111S, 102S. Meanwhile, the timing belt 129 and the pulleys 129A, 129B may transmit the driving force from the rotation shaft 102S to the rotation shaft 121S. Accordingly, the first driving roller 111, the second driving roller 121, and the fourth rollers 102 may rotate. Moreover, the second roller 110 may be rotated by the rotation of the first driving roller 111, the third roller 120 may be rotated by the rotation of the second driving roller 121, and the second pinch rollers 102P may be rotated by the rotation of the fourth rollers 102.

As the first driving roller 111 and the second roller 110 nip the sheet SH guided along the guide surfaces 61, 71 and rotate, the second roller 110 may apply a conveying force to move the sheet SH downstream in the conveying direction D1 and toward the first widthwise end 71L of the guide surface 71 in the widthwise direction W1 to the sheet SH.

As the second driving roller 121 and the third roller 120 nip the sheet SH guided to the guide surfaces 61, 71 and rotate, the third roller 120 may apply a conveying force to move the sheet SH downstream in the conveying direction D1 and toward the first widthwise end 71L of the guide surface 71 in the widthwise direction W1 to the sheet SH.

As the fourth rollers 102 and the second pinch rollers 102P nip the sheet SH guided along the guide surface 71 and rotate, the fourth rollers 102 and the second pinch rollers 102P may apply a conveying force to move the sheet SH downstream in the conveying direction D1.

In the present embodiment, rotation velocities of the rotation shaft 111S of the first driving roller 111 and the rotation shaft 102S of the fourth rollers 102 that are driven to rotate by the driving force transmitted by the transmission 50 are equal.

Meanwhile, an outer diameter DP1 of the pulley 129A is greater than an outer diameter DP2 of the pulley 129B; therefore, a rotation velocity of the rotation shaft 121S of the second driving roller 121 is greater than the rotation velocity of the rotation shafts 111S, 102S.

Moreover, outer diameters of the first driving roller 111, the second driving roller 121, and the fourth rollers 102 are equal.

Therefore, a circumferential velocity of the outer circumferential surface of the second driving roller 121 is greater than circumferential velocity of the outer circumferential surfaces of the first driving roller 111 and the fourth rollers 102. Accordingly, a circumferential velocity of the outer circumferential surface of the third roller 120 is greater than a circumferential velocity of an outer circumferential surface of the second roller 110 and a circumferential velocity of outer circumferential surfaces of the second pinch rollers 102P.

According to the first embodiment, the image forming apparatus 1 includes the inverting-conveyance guide 60, the inverting-conveyance guide 70, the alignment guide 30, the first roller 101, the second roller 110, and the third roller 120 to convey the sheets SH. The image forming apparatus 1 further includes the pin 49, the first driving roller 111, the second driving roller 121, the fourth roller 102, and the timing belt 12. With these components, the image forming apparatus 1 may invert and return the sheet SH with an image formed on the first side SHp thereof once again to the image forming unit 3.

<Benefits>

According to the image forming apparatus 1 in the first embodiment, when the sheet SH (SH1) (see FIG. 5) being standard paper, including thinner paper, is conveyed in the inverting-conveyer path P2 to return to the image forming unit 3, the second roller 110 may apply the conveying force to move the sheet SH (SH1) obliquely toward the first widthwise end 71L of the guide surface 71 to the sheet SH (SH1).

In FIG. 5, transition of the posture of the standard sheet SH (SH1) is denoted by reference sings SP11, SP12. As shown in FIG. 5, as the trailing edge of the standard sheet SH (SH1) is released from the first roller 101 and the first pinch roller 101P, the standard sheet SH (SH1) may run obliquely toward the alignment guide 30, and a leftward edge of the standard sheet SH (SH1) may slide on the pin 49. Moreover, as indicated by an arrow Y1 in FIG. 5, the standard sheet SH (SH1) may turn about the pin 49, and the leftward edge of the standard sheet SH (SH1) may slide on the third guide wall 33 of the alignment guide 30. Thereby, the regular sheet SH (SH1) may align with the third guide wall 33 of the alignment guide 30.

Meanwhile, the third roller 120 is arranged at the position, on the side of the inverting-conveyance guide 70 toward the second widthwise end 71R in the widthwise direction W1, outside the widthwise length LW1 of the sheet SH to be guided by the third wall 33 of the alignment guide 30 on the guide surface 71. In other words, the third roller 120 is arranged at the position displaced rightward from the regulative area E1 in the guide surface 71. Therefore, the rightward edge of the standard sheet SH (SH1) may not reach the third roller 120, and the standard sheet SH (SH1) may not be involved in the rotation of the third roller 120. In other words, the third roller 120 may not contact the rightward edge of the regular sheet SH (SH1) to apply the conveying force to the standard sheet SH (SH1). In this regard, without the effect of the third roller 120, the standard sheet SH may be prevented from being shifted toward the alignment guide 30 excessively, and sheet jam by the standard sheet SH may be restrained.

In the first embodiment, the distance LR1 between the first roller 101 and the third roller 120 in the conveying direction D1 is greater than a sum of the length LD1 of the sheet SH in the conveying direction D1 and a conveying distance LS1, which is required by the second roller 110 to cause the regular sheet SH (SH1) to be guided along the third guide wall 33 of the alignment guide 30. With this arrangement, the standard sheet SH (SH1) may be restrained from being affected by the conveying force of the third roller 120 even more effectively.

Figure 6:
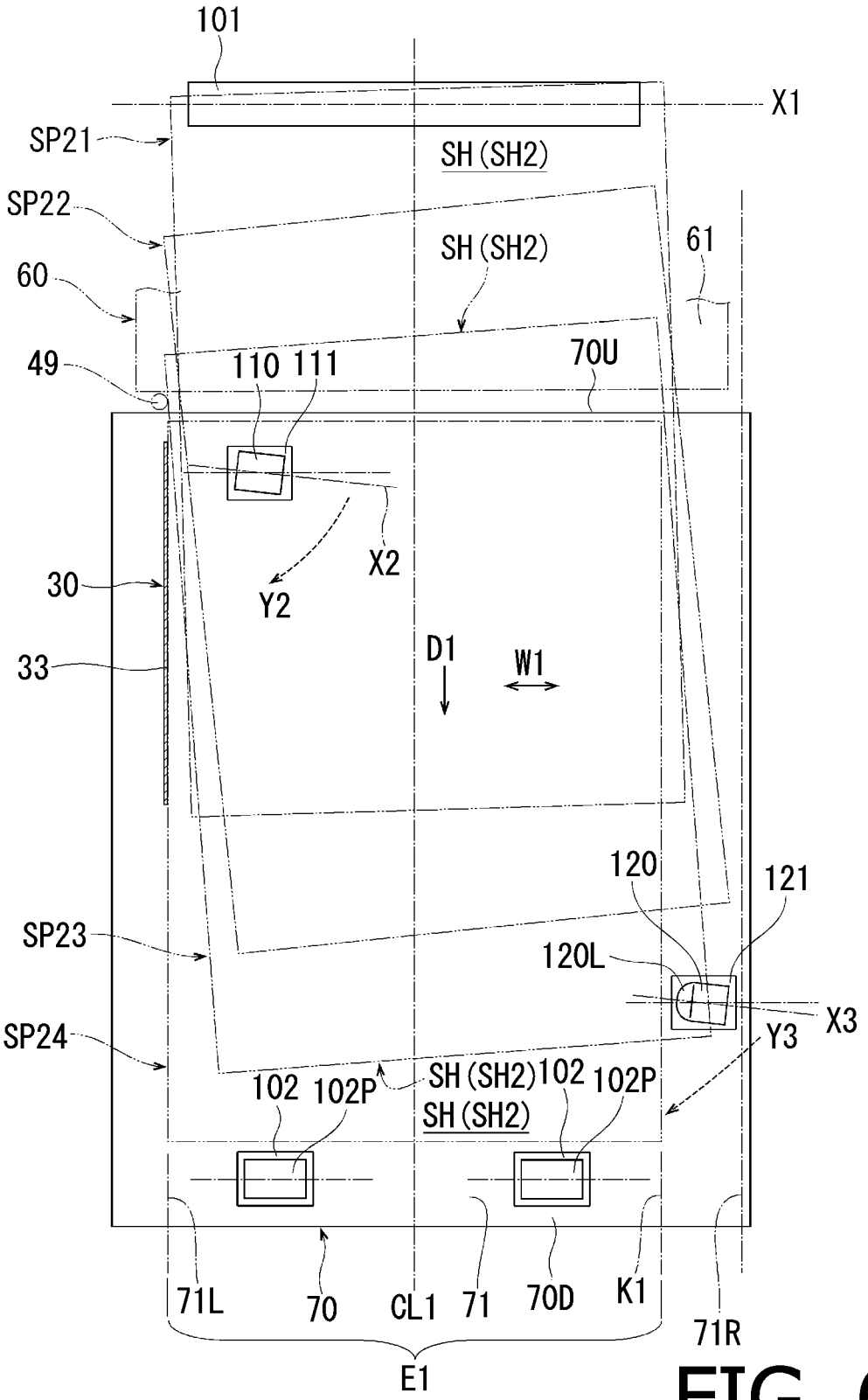
FIG. 6 is another plan view to illustrate the arrangement of the alignment guide, the pin, the first roller, the second roller, and the third roller for the image forming apparatus according to the first embodiment of the present disclosure.

On the other hand, as shown in FIG. 6, when a thicker sheet SH (SH2) is conveyed in the inverting-conveyer path P2 to return to the image forming unit 3, some problems may rise. That is, the thicker sheet SH (SH2) may weigh more and may be more rigid compared to the standard sheet SH (SH1). Therefore, a conveying resistance, which may be caused by friction between the sheet SH (SH2) and the guide surfaces 61, 71, to act on the sheet SH (SH2) may be greater compared to the standard sheet SH (SH1). In FIG. 6, transition of the posture of the thicker sheet SH (SH2) is denoted by reference sings SP21, SP22, SP23, SP24. As shown in FIG. 6, the conveying force produced by the second roller 110 to convey the thicker sheet SH (SH2) toward the first widthwise end 71L of the guide surface 71 may be less intense than the conveying resistance acting on the thicker sheet SH (SH2), and the thicker sheet SH (SH2) may not be conveyed substantially to align with the alignment guide 30. For example, when the leftward end of the thicker sheet SH (SH2) slide on the pin 49, as indicated by an arrow Y2 in FIG. 6, the thicker sheet SH (SH2) may not turn for a sufficient amount about the 49.

Such an insufficient turning behavior of the thicker sheet SH (SH2) may likely to occur when the thicker sheet SH (SH2) is twisted by the second roller 110 before the trailing edge of the thicker sheet SH (SH2) is released from the first roller 101 and the first pinch roller 101P so that the thicker sheet SH (SH2) may accumulate a restoring force therein, and thereafter when the trailing end of the thicker sheet SH (SH2) is finally released from the first roller 101 and the first pinch roller 101P as the accumulated restoring force is released.

Under such circumstance, a part of the thicker sheet SH (SH2) conveyed along the guide surfaces 61, 71 may stray outside the regulative area E1 toward the second widthwise end 71R of the guide surface 71. Meanwhile, as indicated by the reference sign SP23, the part of the thicker sheet SH (SH2) straying outside the regulative area E1 may contact the third roller 120. Thus, the third roller 120 may apply the conveying force to move the thicker sheet SH (SH2) toward the first widthwise end 71L of the guide surface 71 to the thicker sheet SH (SH2).

Thereby, as indicated by an arrow Y3 in FIG. 6, the thicker sheet SH (SH2) may turn about the pin 49 to be directed to the regulative area E1. Meanwhile, the circumferential velocity of the outer circumferential surface of the third roller 120 is greater than the circumferential velocity of the outer circumferential surface of the second roller 110; therefore, the third roller 120 may turn the thicker sheet SH (SH2) about the pin 49 quickly and effectively.

Moreover, as denoted by the reference sign SP24, the leftward edge of the thicker sheet SH (SH2) may slide on the third wall 33 of the alignment guide 30. Thereby, the thicker sheet SH (SH2) may be urged against the third guide wall 33 of the alignment guide 30. Meanwhile, the thicker sheet SH (SH2) may be more rigid than the standard sheet SH (SH1); therefore, even if the thicker sheet SH (SH2) is conveyed by the second roller 110 and the third roller 120 at the same time, the sheet SH (SH2) may be prevented from being twisted or jammed in the inverting-conveyer path P2.

Meanwhile, for example, depending on slipperiness or rigidity of the thicker sheet SH (SH2), the thicker sheet SH (SH2) may not necessarily be conveyed in the postures SP21-SP24 shown in FIG. 6 but may be conveyed in the postures SP11, SP12 similarly to the standard sheet SH (SH1) as shown in FIG. 5. In such a case, the thicker sheet SH (SH2) may be conveyed by the second roller 110 to align with the third guide wall 33 of the alignment guide 30 without being affected by the third roller 120.

In other words, in the image forming apparatus 1, the widthwise position of the sheet SH may be preferably regulated by the third guide wall 33 of the alignment guide 30 regardless of whether the sheet SH is the standard sheet SH (SH1) including a thinner sheet or the thicker sheet SH (SH2).

The sheet SH (SH1, SH2) preferably aligning with the third guide wall 33 of the alignment guide 30 may be conveyed through the regulative area E1 on the guide surface 71 maintaining the regulated correct widthwise position to return to the image forming unit 3 by being conveyed by the fourth rollers 102 and the second pinch rollers 102P. Accordingly, an image may be formed preferably on the other side of the sheet SH (SH1, SH2) opposite to the first side SHp.

Thus, the image forming apparatus 1 according to the first embodiment may restrict the sheet SH from being conveyed in the inverting-conveyer path P2 in a skewed posture with respect to the alignment guide 30.

Moreover, in the image forming apparatus 1, as shown in FIG. 5, the distance LR1 in the conveying direction D1 between the first roller 101 and the third roller 120 is greater than the length LD1 of the sheet SH in the conveying direction D1. In this regard, the sheet SH (SH1, SH2) may not be affected simultaneously by all of the first roller 101, the second roller 110, and the third roller 120. Therefore, the sheet SH (SH1, SH2) may be restrained from malfunction, which may unless otherwise be caused by the sheet SH (SH1, SH2) if the sheet SH (SH1, SH2) is affected simultaneously by the first roller 101, the second roller 110, and the third roller 120 and twisted.

Moreover, in the image forming apparatus 1, as shown in FIG. 3, the outer diameter DP1 of the pulley 129A is greater than the outer diameter DP2 of the pulley 129B. Therefore, the circumferential velocity of the outer circumferential surface of the third roller 120 is greater than the circumferential velocity of the outer circumferential surface of the second roller 110. In this regard, the third roller 120 may apply the conveying force to move the sheet SH toward the first widthwise end 71L of the guide surface 71 to the sheet SH more effectively than the second roller 110. Therefore, as indicated by the arrow Y3 in FIG. 6, the third roller 120 may apply the conveying force to move the thicker sheet SH (SH2) obliquely toward the first widthwise end 71L of the guide surface 71 to the part of the thicker sheet SH (SH2) straying outside the regulative area E1 so that the thicker sheet SH (SH2) directed to the regulative area E1 may effectively align with the third guide wall 33 of the alignment guide 30. Meanwhile, the circumferential velocities may be changed easily by controlling or adjusting the reduction rates in the driving force flows so that the arrangement to convey the sheet SH may be modified later.

Moreover, in the image forming apparatus 1, as indicated by the arrows Y1, Y2, Y3 in FIGS. 5-6, the pin 49 may cause the sheet SH (SH1, SH1) to turn there-around effectively so that the sheet SH (SH1, SH2) may be guided to align with the third guide wall 33 of the alignment guide 30.

Moreover, in the image forming apparatus 1, as shown in FIG. 6, the leftward end 120L of the third roller 120 is in the rounded or hemispherical form. Therefore, the part of the thicker sheet SH (SH2) straying outside the regulative area E1 may first contact the rounded leftward end 120L of the third roller 120 and thereafter contact the outer circumferential surface of the cylindrical third roller 120 to be moved toward the first widthwise end 71L of the guide surface 71. In this regard, the part of the thicker sheet SH (SH2) straying outside the regulative area E1 may slide underneath the third roller 120 easily and may be prevented from being caught by the third roller 120. Therefore, the sheet SH to be inverted to return to the image forming unit 3 may be restrained from sheet jam.

Moreover, in the image forming apparatus 1, as shown in FIG. 3, the second roller 110 is rotated by the rotation of the first driving roller 111, and the third roller 120 is rotated by the rotation of the second driving roller 121. In other words, the second roller 110 and the third roller 120 are in separate driving lines. Therefore, the inclination of the second axis X2 of the second roller 110 with respect to the widthwise direction W1 and the inclination of the third axis X3 of the third roller 120 may be determined and adjusted individually.

Moreover, in the image forming apparatus 1, as shown in FIG. 3, the driving force may be transmitted from the rotation shaft 102S of the fourth roller 102 to the rotation shaft 121S of the second driving roller 121 through the simple structure using the timing belt 129. Therefore, the third roller 120 may be effectively rotated with use of the rotation of the second driving roller 121.

Second Embodiment

Figure 7:
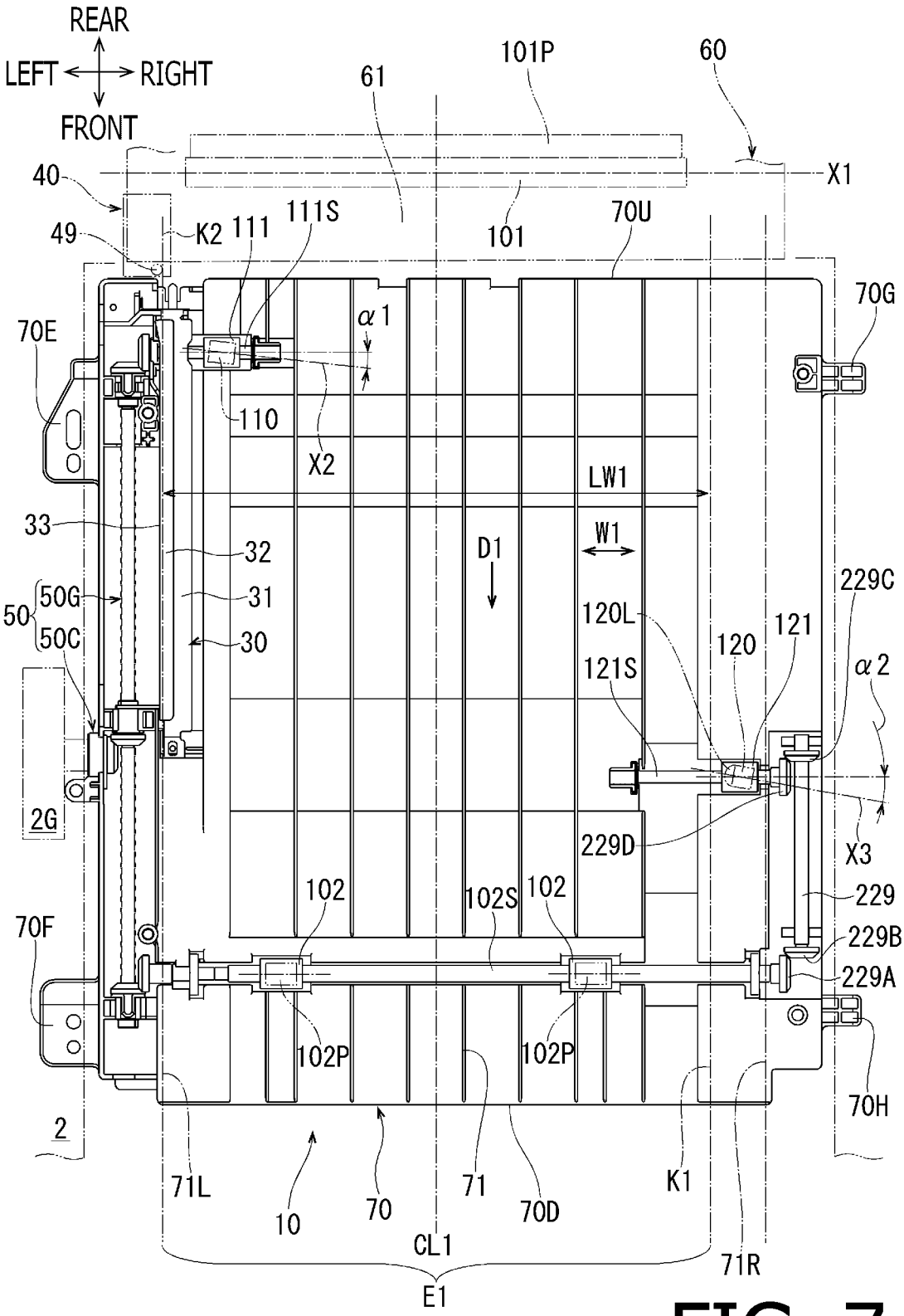
FIG. 7 is a plan view of the inverting-conveyance guides, the first roller, the second roller, the third roller, the first driving roller, the second driving roller, and the fourth roller for the image forming apparatus according to a second embodiment of the present disclosure.

With reference to FIG. 7, below will be described a second embodiment of the present disclosure. As shown in FIG. 7, an image forming apparatus in the second embodiment has a transmission shaft 229 extending in the conveying direction D1 and bevel gears 229A, 229B, 229C, 229D in place of the timing belt 129 and the pulleys 129A, 129B in the image forming apparatus 1 described in the first embodiment. Quantities of teeth in the bevel gear 229A and in the bevel gears 229D are equal. Quantities of teeth in the bevel gear 229B and in the bevel gear 229C are equal. The bevel gear 229A is fixed at a rightward end of the rotation shaft 120S meshes with the bevel gear 229B, which is fixed to a downstream end of the transmission shaft 229 in the conveying direction D1; and the bevel gear 229C is fixed to an upstream end of the transmission shaft 229 in the conveying direction D1 and meshes with the bevel gear 229D, which is fixed to the rightward end of the rotation shaft 121S. Therefore, the rotation shaft 111S, the rotation shaft 102S, and the rotation shaft 121S may rotate at an equal velocity. Accordingly, the circumferential velocity of the outer circumferential surface of the third roller 120 and the circumferential velocity of the outer circumferential surface of the second roller 110 are equal. Meanwhile, the inclination of the third axis X3 of the third roller 120 with respect to the widthwise direction W1 is an angle $\alpha 2$, which is greater than the angle $\alpha 1$.

The remaining structure of the image forming apparatus in the second embodiment may be identical to the structure of the image forming apparatus 1 in the first embodiment and will be referred to by the same reference signs, and description of those will be herein omitted.

With the image forming apparatus according to the second embodiment, the sheet SH to return to the image forming unit 3 through the inverting-conveyer path P2 may be restrained from being conveyed in a skewed posture with respect to the alignment guide 30 similarly to the sheet SH to be conveyed in the image forming apparatus 1 in the first embodiment.

Moreover, in the image forming apparatus in the second embodiment, the angle $\alpha 2$ of the inclination of the third axis X3 with respect to the widthwise direction W1 is greater than the angle $\alpha 1$ of the inclination of the second axis X2 with respect to the widthwise direction W1. Therefore, the third roller 120 may apply the conveying force to move the sheet SH toward the first widthwise end 71L of the guide surface 71 more effectively than the second roller 110. Accordingly, the third roller 120 may apply the conveying force to move the sheet SH obliquely toward the first widthwise end 71L of the guide surface 71 to the part of the sheet SH straying outside the regulative area E1 so that the sheet SH may be directed to the regulative area E1, and the sheet SH directed in the regulative area E1 may effectively align with the third guide wall 33 of the alignment guide 30.

Third Embodiment

Figure 8:
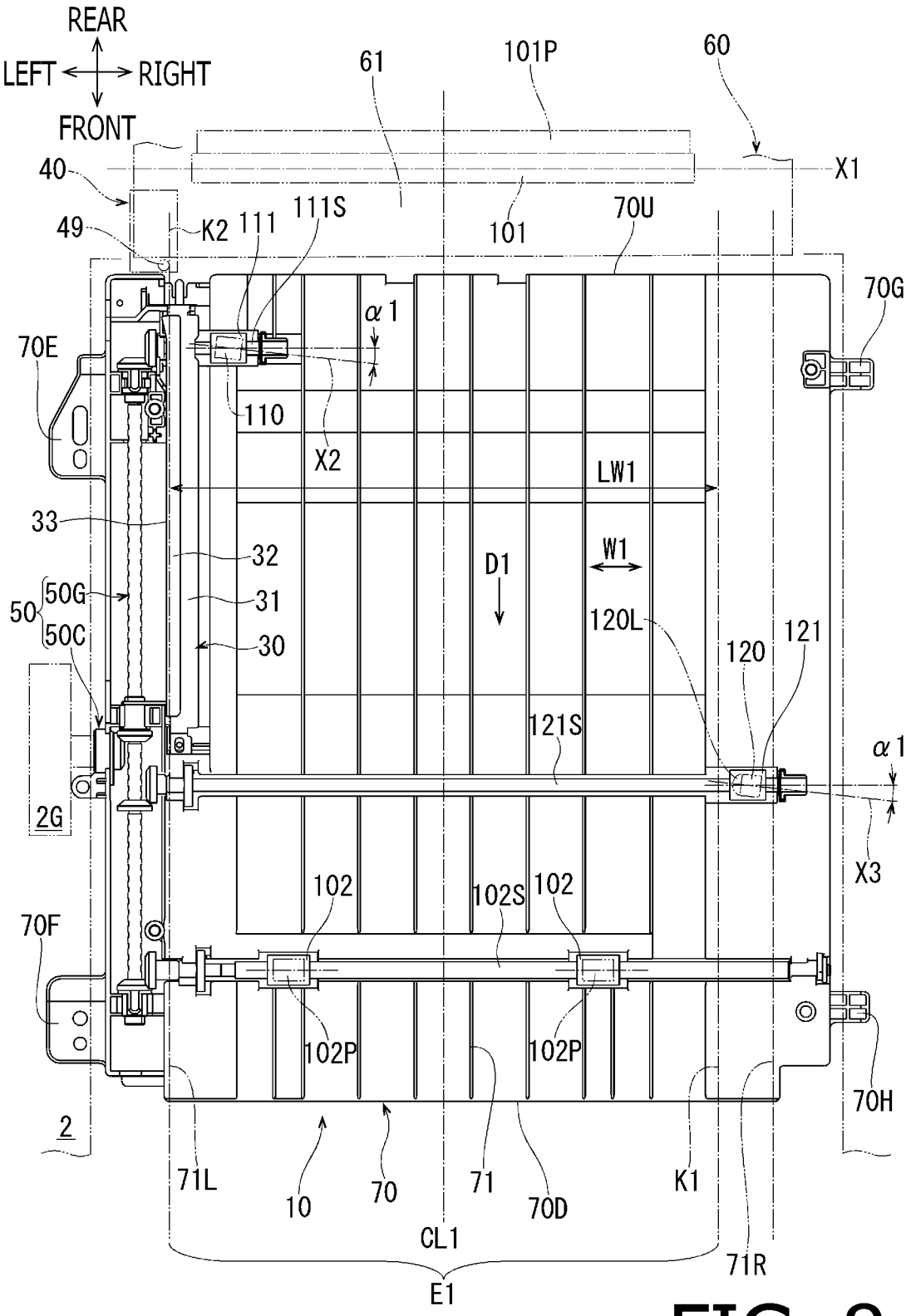
FIG. 8 is a plan view of the inverting-conveyance guides, the first roller, the second roller, the third roller, the first driving roller, the second driving roller, and the fourth roller for the image forming apparatus according to a third embodiment of the present disclosure.

With reference to FIG. 8, below will be described a third embodiment of the present disclosure. As shown in FIG. 8, an image forming apparatus in the third embodiment has neither the timing belt 129 nor the pulleys 129A, 129B. Meanwhile, the rotation shaft 121S in the image forming apparatus in the third embodiment is elongated leftward, and a leftward end of the rotation shaft 121S is coupled to the transmission gear assembly 50G in the transmission 50. A quantity of teeth in a bevel gear at the leftward end of the rotation shaft 121S is adjusted so that the rotation shaft 121S should rotate at the equal velocity as the velocity of the rotation shafts 111S, 102S. Therefore, the circumferential velocity of the outer circumferential surface of the third roller 120 and the circumferential velocity of the outer circumferential surface of the second roller 110 are equal.

The remaining structure of the image forming apparatus in the third embodiment may be identical to the structure of the image forming apparatus 1 in the first embodiment and will be referred to by the same reference signs, and description of those will be herein omitted.

With the image forming apparatus according to the third embodiment, the sheet SH to return to the image forming unit 3 through the inverting-conveyer path P2 may be restrained from being conveyed in a skewed posture with respect to the alignment guide 30 similarly to the sheet SH to be conveyed in the image forming apparatuses in the first and second embodiments.

Fourth Embodiment

In the image forming apparatus 1 in the first embodiment, the spring load by the urging spring 110T and the spring load by the urging spring 120T are equal. Meanwhile, in the fourth embodiment, the spring loads by the urging springs 110T, 120T are unequal. For example, a spring load T1 by the urging spring 110T may be set to be smaller than a spring load T2 by the urging force 120T ($T1<T2$). In other words, an intensity of the force to press the third roller 120 against the sheet SH being guided on the guide surface 71 is greater than an intensity of a force to press the second roller 110 against the sheet SH being guided on the guide surface 71. The remaining structure of the image forming apparatus in the fourth embodiment may be identical to the structure of the image forming apparatus 1 in the first embodiment and, and description and illustration of those will be herein omitted.

With the image forming apparatus according to the fourth embodiment, the benefits achievable by the image forming apparatuses in the first through fourth embodiments may be similarly achievable. Moreover, according to the image forming apparatus in the fourth embodiment, with the spring load T2 being greater than the spring load T1, the third roller 120 may be less likely to slip on the sheet SH compared to the second roller 110 and may apply the conveying force to the sheet SH more effectively. Therefore, the third roller 120 may apply the conveying force to move the sheet SH obliquely toward the first widthwise end 71L of the guide surface 71 to the part of the sheet SH straying outside the regulative area E1 so that the sheet SH (SH2) directed to the regulative area E1 may effectively align with the third guide wall 33 of the alignment guide 30.

Although examples of carrying out the invention has been described, those skilled in the art will appreciate that there are numerous variations and permutations of the sheet conveyer and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the second roller 110 and the third roller 120 may not necessarily be subordinately driven by the rotation of the first driving roller 111 and the second driving roller 121, respectively, but the second roller 110 and the third roller 120 may be driving rollers that may rotate by driving forces transmitted from the driving source.

In the first embodiment, the circumferential velocity of the third roller 120 is greater than the circumferential velocity of the second roller 110 while the inclination angle of the second axis X2 is equal to the inclination angle of the third axis X3. In the second embodiment, the circumferential velocity of the second roller 110 is equal to the circumferential velocity of the third roller 120 while the inclination angle of the third axis X3 is greater than the inclination angle of the second axis X2. In the third embodiment, the circumferential velocity of the second roller 110 is equal to the circumferential velocity of the third roller 120 while the inclination angle of the second axis X2 is equal to the inclination angle of the third axis X3. In the fourth embodiment, the intensity of the force to press the third roller 120 is greater than the intensity of the force to press the second roller 110. Meanwhile, the relativities between the circumferential velocities of the second roller 110 and the third roller 120, between the inclination angles of the second axis X2 and the third axis X3, and between the intensities of the forces to press the second roller 110 and the third roller 120, may not necessarily be limited to those described in each of the first through fourth embodiments but may be combined with one another to form a configuration different from any of the first through fourth embodiments.

For another example, the configuration to convey the sheet SH obliquely on the guide surface 71 may not necessarily be applied in the inverting-conveyer path P2 alone but may also be applied to a sheet conveyer that does not have an inverting-conveyer path so that the sheet being conveyed in the sheet conveyer may be restrained from being conveyed in a skewed posture with respect to the alignment guide.

For another example, the present disclosure may not necessarily be applied to the image forming apparatus 1 being a laser printer but may be applied to, for example, another type of image forming apparatus, an image reading apparatus, and a multifunction peripheral machine.

What is claimed is:

1. A sheet conveyer, comprising:

a first guide including a guide surface, the guide surface being configured to guide a sheet thereon in a conveying direction;

a second guide arranged at a position on a side of the guide surface closer to a first end in a widthwise direction, the widthwise direction being orthogonal to the conveying direction, the second guide being configured to regulate a position of the sheet in the widthwise direction by contacting the sheet being guided on the guide surface;

a first roller arranged at a position upstream in the conveying direction with respect to the second guide, the first roller being configured to rotate about a first axis extending in parallel with the widthwise direction, the first roller being configured to apply a conveying force to the sheet to be guided on the guide surface to move downstream in the conveying direction;

a second roller arranged at a position downstream in the conveying direction with respect to the first roller, the second roller being arranged at a position in the widthwise direction closer to the first end of the guide surface than a widthwise center of a regulative area in which a regulated sheet is conveyed in a regulated posture at a predetermined position on the guide surface in the widthwise direction, the second roller being configured to rotate about a second axis inclined with respect to the widthwise direction, the second roller being configured to apply a conveying force to move the sheet being guided on the guide surface toward the first end of the guide surface in the widthwise direction; and a third roller arranged at a position downstream in the conveying direction with respect to the second roller, the third roller being arranged at a position in the widthwise direction on a side of the widthwise center of the regulative area opposite to the first end of the guide surface and closer to a second end of the guide surface, the position being located outside a length of the sheet to be guided in the widthwise direction and outside the regulative area, the third roller being configured to rotate about a third axis inclined with respect to the widthwise direction, the third roller being configured to apply a conveying force to the sheet being guided on the guide surface to move downstream in the conveying direction and toward the first end of the guide surface in the widthwise direction.

2. The sheet conveyer according to claim 1, wherein a distance between the first roller and the third roller in the conveying direction is longer than a length of the sheet to be guided on the guide surface in the conveying direction.

3. The sheet conveyer according to claim 1, wherein a circumferential velocity of an outer circumferential surface of the third roller is greater than a circumferential velocity of an outer circumferential surface of the second roller.

4. The sheet conveyer according to claim 1, wherein an angle of inclination of the third axis with respect to the widthwise direction is greater than an angle of inclination of the second axis with respect to the widthwise direction.

5. The sheet conveyer according to claim 1, wherein an intensity of a force to press the third roller against the sheet being guided on the guide surface is greater than an intensity of a force to press the second roller against the sheet being guided on the guide surface.

6. The sheet conveyer according to claim 1, further comprising a pin in a cylindrical shape, the pin being arranged at a position downstream in the conveying direction with respect to the first roller and upstream in the conveying direction with respect to the second guide and the second roller, the pin being arranged at a position on the side of the guide surface toward the first end in the widthwise direction, the pin being configured to regulate a position of the sheet in the widthwise direction by contacting the sheet to be guided on the guide surface.

7. The sheet conveyer according to claim 1, wherein an end of the third roller toward the first end of the guide surface in the widthwise direction is rounded.

8. The sheet conveyer according to claim 1, further comprising:

a first driving roller arranged at a position on a same side of the first guide as the guide surface to face the second roller being on an opposite side of the first guide; and a second driving roller arranged at a position on the same side of the first guide as the guide surface to face the third roller being on the opposite side of the first guide, wherein the second roller is pressed against the first driving roller and is configured to be rotated subordinately by rotation of the first driving roller, and wherein the third roller is pressed against the second driving roller and is configured to be rotated subordinately by rotation of the second driving roller.

9. The sheet conveyer according to claim 8, further comprising:

a fourth roller arranged at a position downstream in the conveying direction with respect to the third roller, the fourth roller being configured to rotate integrally with a rotation shaft extending in parallel with the widthwise direction, the fourth roller being configured to apply a conveying force to the sheet being guided on the guide surface to move downstream in the conveying direction; and a belt configured to transmit a driving force from the rotation shaft to the second driving roller.

10. An image forming apparatus, comprising;

a sheet conveyer comprising:

a first guide including a guide surface, the guide surface being configured to guide a sheet thereon in a conveying direction;

a second guide arranged at a position on a side of the guide surface toward one a first end in a widthwise direction, the widthwise direction being orthogonal to the conveying direction, the second guide being configured to regulate a position of the sheet in the widthwise direction by contacting the sheet being guided on the guide surface;

a first roller arranged at a position upstream in the conveying direction with respect to the second guide, the first roller being configured to rotate about a first axis extending in parallel with the widthwise direction, the first roller being configured to apply a conveying force to the sheet to be guided on the guide surface to move downstream in the conveying direction;

a second roller arranged at a position downstream in the conveying direction with respect to the first roller, the second roller being arranged at a position in the widthwise direction closer to the first end of the guide surface than a widthwise center of a regulative area in which a regulated sheet is conveyed in a regulated posture at a predetermined position on the guide surface in the widthwise direction, the second roller being configured to rotate about a second axis inclined with respect to the widthwise direction, the second roller being configured to apply a conveying force to move the sheet being guided on the guide surface toward the first end of the guide surface in the widthwise direction; and a third roller arranged at a position downstream in the conveying direction with respect to the second roller, the third roller being arranged at a position in the widthwise direction on a side of the widthwise center of the regulative area opposite to the first end of the guide surface and closer to a second end of the guide surface, the position being located outside a length of the sheet to be guided in the widthwise direction and outside the regulative area, the third roller being configured to rotate about a third axis inclined with respect to the widthwise direction, the third roller being configured to apply a conveying force to the sheet being guided on the guide surface to move downstream in the conveying direction and toward the first end of the guide surface in the widthwise direction; and an image forming unit configured to form an image on the sheet, wherein the sheet conveyer is configured to convey the sheet with the image formed on one side thereof exiting the image forming unit to return to the image forming unit.

* * * * *